US006405831B1

(12) United States Patent
Daniel, III

(10) Patent No.: US 6,405,831 B1
(45) Date of Patent: Jun. 18, 2002

(54) MOBILE LIFT UNIT

(75) Inventor: James P. Daniel, III, Florence, SC (US)

(73) Assignee: Aluminum Ladder Company, Florence, SC (US)

( * ) Notice: Subject to any disclaimer, the term of this patent is extended or adjusted under 35 U.S.C. 154(b) by 0 days.

(21) Appl. No.: 09/723,871

(22) Filed: Nov. 28, 2000

(51) Int. Cl.[7] ..... E06C 5/00
(52) U.S. Cl. ..... 182/127; 182/115; 182/141
(58) Field of Search ..... 182/113, 116, 182/115, 63.1, 141, 127, 9, 223

(56) References Cited

U.S. PATENT DOCUMENTS 2,777,737 A * 1/1957 Balogh ..... 182/115
3,204,721 A * 9/1965 Park ..... 182/115
3,232,377 A * 2/1966 Smith ..... 182/115
3,817,347 A * 6/1974 Spencer ..... 182/115
3,882,964 A * 5/1975 Schellenberg ..... 182/127 X
4,390,080 A * 6/1983 Bushnell, Jr. ..... 182/127 X
4,484,366 A * 11/1984 Koontz ..... 5/86
4,529,063 A * 7/1985 Kishi ..... 182/141 X
5,111,907 A * 5/1992 Kishi ..... 182/127 X
5,299,653 A * 4/1994 Nebel ..... 182/141 X
5,538,382 A * 7/1996 Hasegawa et al. ..... 414/141.7
5,862,827 A * 1/1999 Howze ..... 135/901
5,927,440 A * 7/1999 Freeman ..... 187/270

* cited by examiner

*Primary Examiner*—Bruce A. Lev
(74) *Attorney, Agent, or Firm*—Charles L. Schwab; Nexsen Pruet Jacobs & Pollard, LLC

(57) ABSTRACT

A mobile human life unit includes an elevatable platform supported by a ladder mounted on a wheeled vehicle. A first embodiment of the mobile human lift unit utilizes a winch with a winch cable reeved over a pulley carried by a support having at least three legs which are held in fixed positions on the platform. A second embodiment of the mobile human lift unit has an overhead crane with a track which swings about a vertical pivot axis and carries a trolley with a winch.

9 Claims, 4 Drawing Sheets

MOBILE LIFT UNIT

TECHNICAL FIELD

This invention relates to mobile lifts and more particularly to wheeled lifts having an elevatable platform with a hoist for rescuing a human from an enclosure; as well as lowering a human into and removing a human from an enclosure.

BACKGROUND ART

Mobile lifts have been used to elevate materials and workmen for a variety of purposes. One such lift includes a chassis mounted on four wheels with one section of an extension ladder rigidly supported on the chassis at an obtuse angle. An extensible section of the ladder supports a horizontal work platform. A hand winch is used to elevate and lower the extensible section of the ladder with the supported work platform. The work platform extends beyond the chassis of the mobile lift to permit placement of material or personnel beyond the area in which the wheeled chassis is free to travel. The platform may include a vertical entryway to permit access to the top opening of a container when the platform rests on the container with the entryway aligned with the top opening. Although these previously designed mobile lifts are advantageously used in numerous applications, there remains a need for equipment to quickly aid in rescue of incapacitated personnel from enclosures, such as storage tanks.

DISCLOSURE OF THE INVENTION

The present invention is directed to providing a mobile human lift unit for rescuing personnel from enclosures. An overhead hoist is mounted on an elevatable platform having a vertical entryway. The overhead hoist includes a winch having a cable reeved on an overhead pulley with its free end attachable to a human lift harness or the like. The rescue equipment is mobile to permit it to be quickly positioned to effect a human rescue operation. The platform is vertically adjustable to correspond to the height of a variety enclosures. The overhead hoist may take the form of a tripod, an overhead track and dolly or an overhead crane. The use of an overhead crane which pivots about a vertical axis, facilitates lowering of a rescued person to the ground.

DETAILED DESCRIPTION OF THE INVENTION

Figure 1:
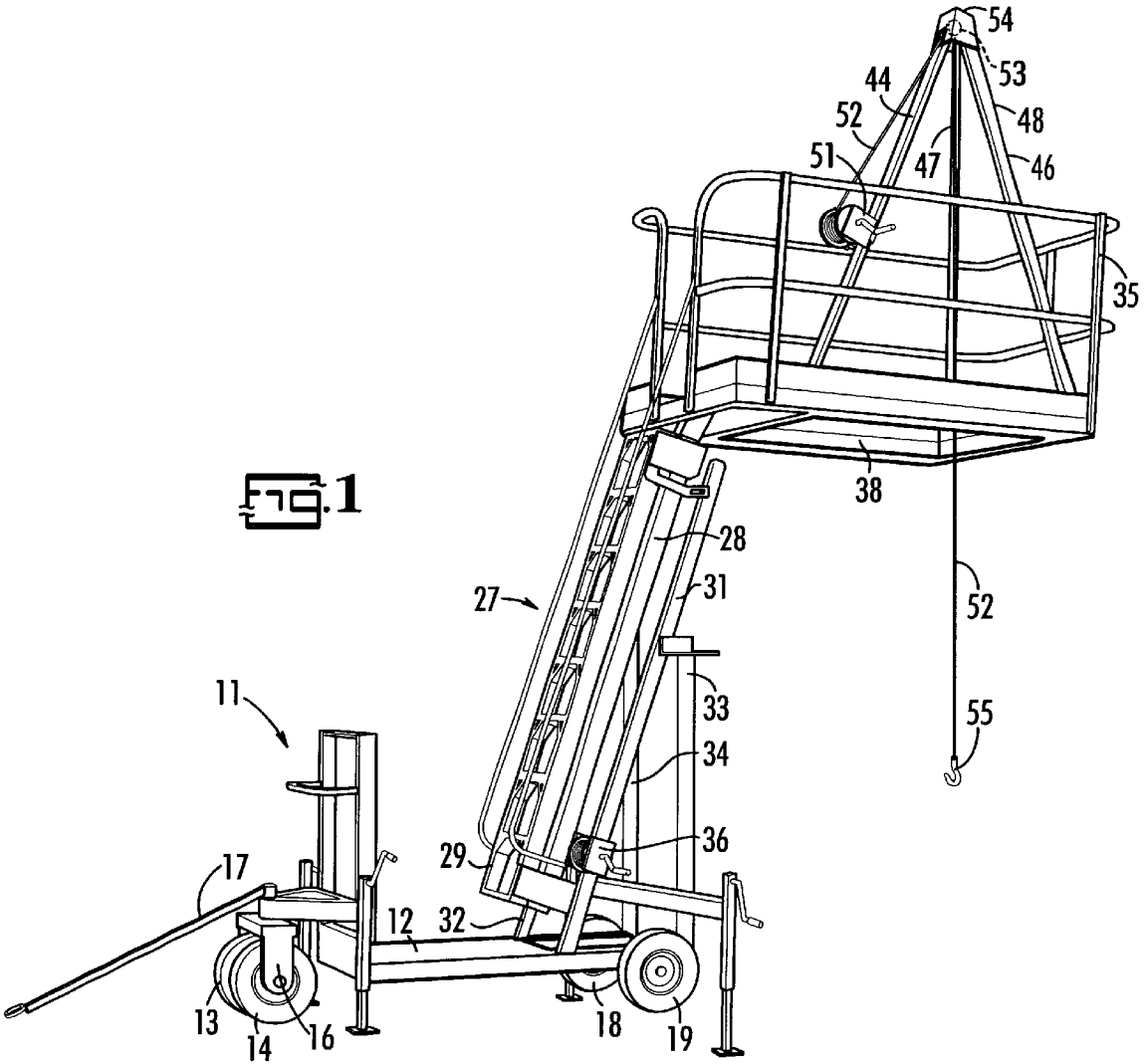
FIG. 1 is a perspective view of a first embodiment of the invention showing a mobile human lift unit having a tripod mounted on an elevatable platform.

The mobile human lift unit shown in FIG. 1 includes a wheeled support vehicle 11 having a chassis 12 supported at it front end by a pair of side-by-side support wheels 13, 14 rotatably mounted on a steering fork 16. The steering fork 16 is pivotally connected to a forward projecting part of the chassis 12 and the top end of the steering fork 16 is pivotally connected to a tow bar 17. The rear of the chassis 12 is supported by a pair of laterally spaced support wheels 18, 19 and outriggers with vertically adjustable feet are secured to the chassis 12 to level and stabilize the chassis when it is placed in a rescue position.

A horizontal platform 26 is supported by a support structure which includes a ladder 27 whose extensible or fly section 28 is rigidly secured to the platform and whose butt section 29 is rigidly secured to the chassis by braces 31, 32, 33, 34. A hand operated winch 36 is provided to adjust the extension of the ladder, thus adjusting the elevation of the platform 26. The ladder 27 not only adjustably supports the platform, but also provides access to the platform 26. The ladder 27 extends upwardly at an obtuse angle from the front end of the chassis 12, whereby the platform 26 extends horizontal beyond the chassis 12 a sufficient distance to permit the platform 26 to be placed directly above the top opening of a container, tank or enclosure of the type having a top opening. A guard rail 35 is provided on the platform 26 in conformance with safety standards.

Figure 2:
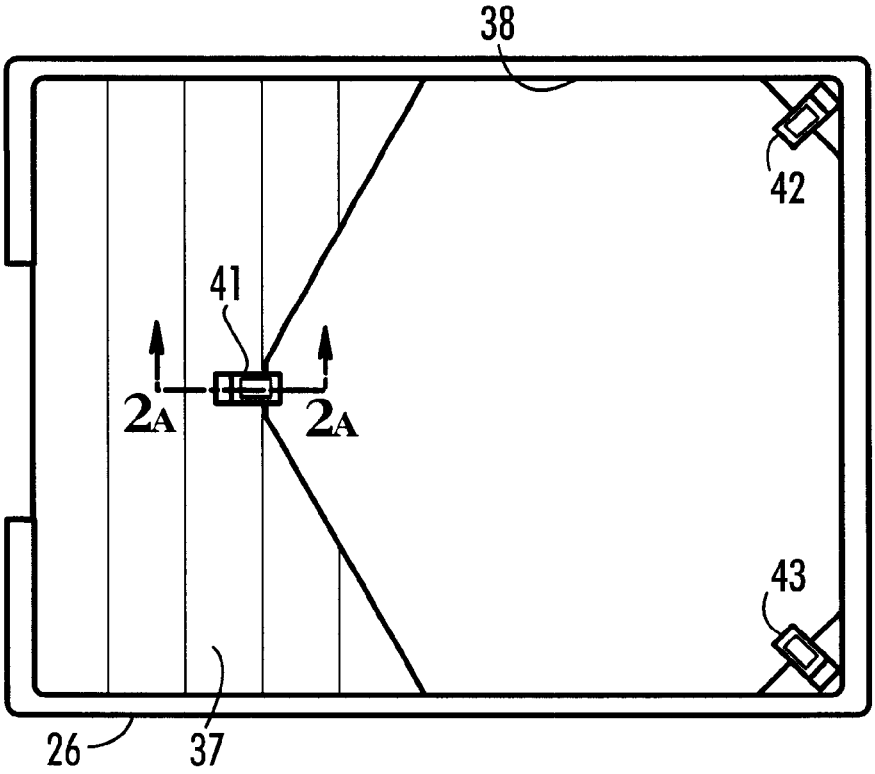
FIG. 2 is a top view of the platform of FIG. 1 with some parts removed for illustration purposes.
Figure 2A:
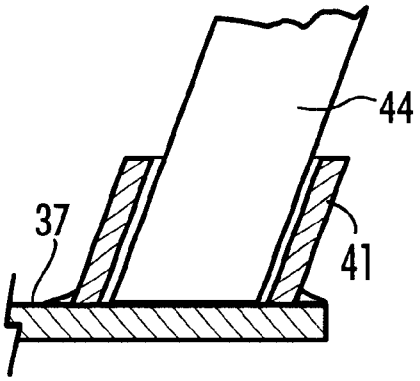
FIG. 2A is a view taken on the line 2A—2A in FIG. 2.

Referring also to FIG. 2, the platform 26 has a floor 37 and a vertical opening or entryway 38 which is sufficiently large to permit vertical passage of a human. Three sockets or support members 41, 42, 43 are mounted on the platform 26 and are shaped and spaced about the entryway 38 to matingly receive the bottom ends of the legs 44, 46, 47 of a tripod 48. FIG. 2A shows the leg 44 positioned in the support member 41.

As shown in FIG. 1, a hand operated winch 51 is rigidly mounted on the leg 44 of the tripod 48 and includes a cable 52 which is reeved on a pulley 52 rotatably supported on an apex or pulley support member 54 to which the upper ends of the tripod legs 44, 46, 47 are attached. The free end of the cable 52 is provided with a hook 55, or, preferably, a releasable connector suitable for attachment to a human lift harness.

Figure 3:
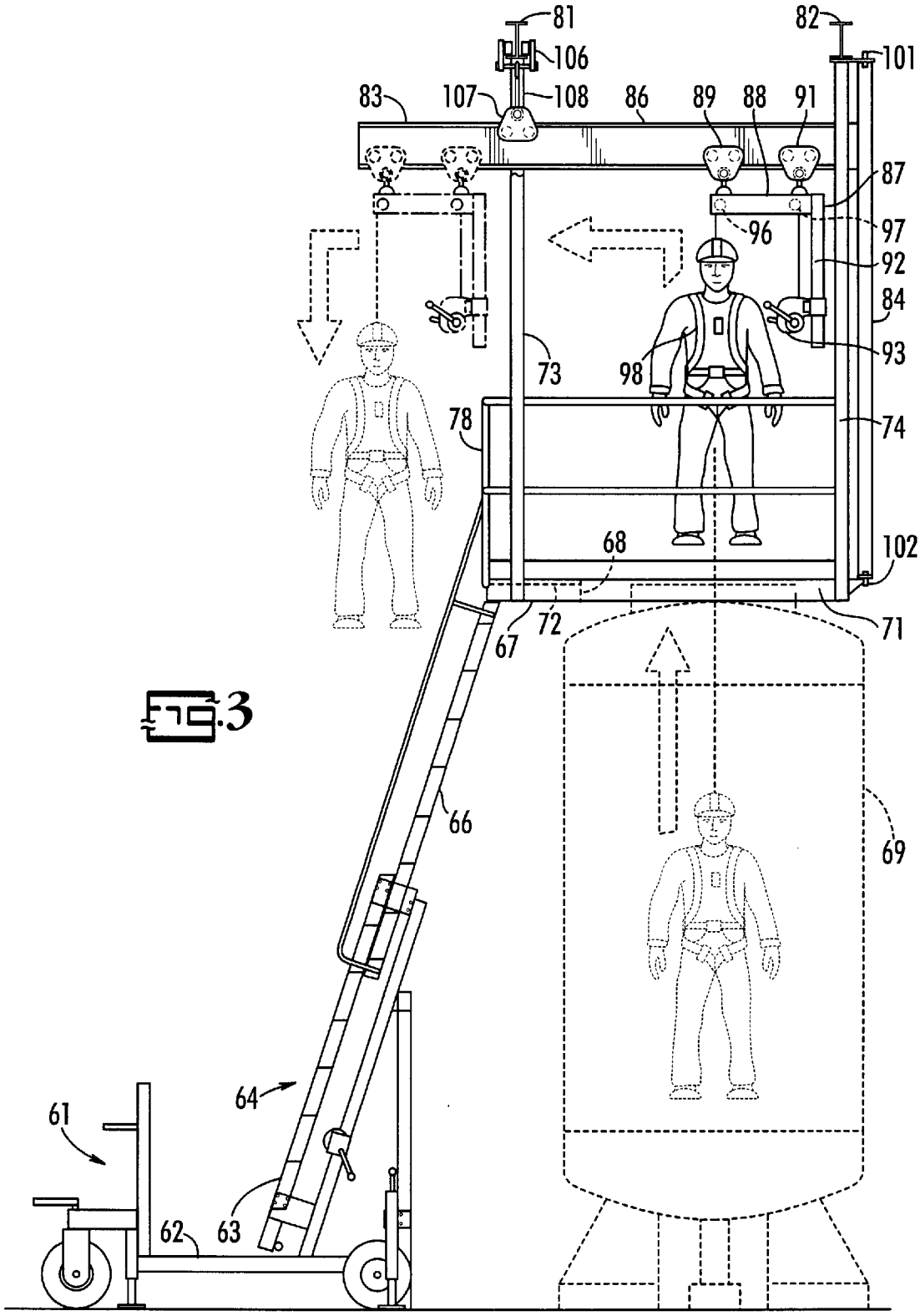
FIG. 3 is a side view of a second embodiment of the invention.
Figure 4:
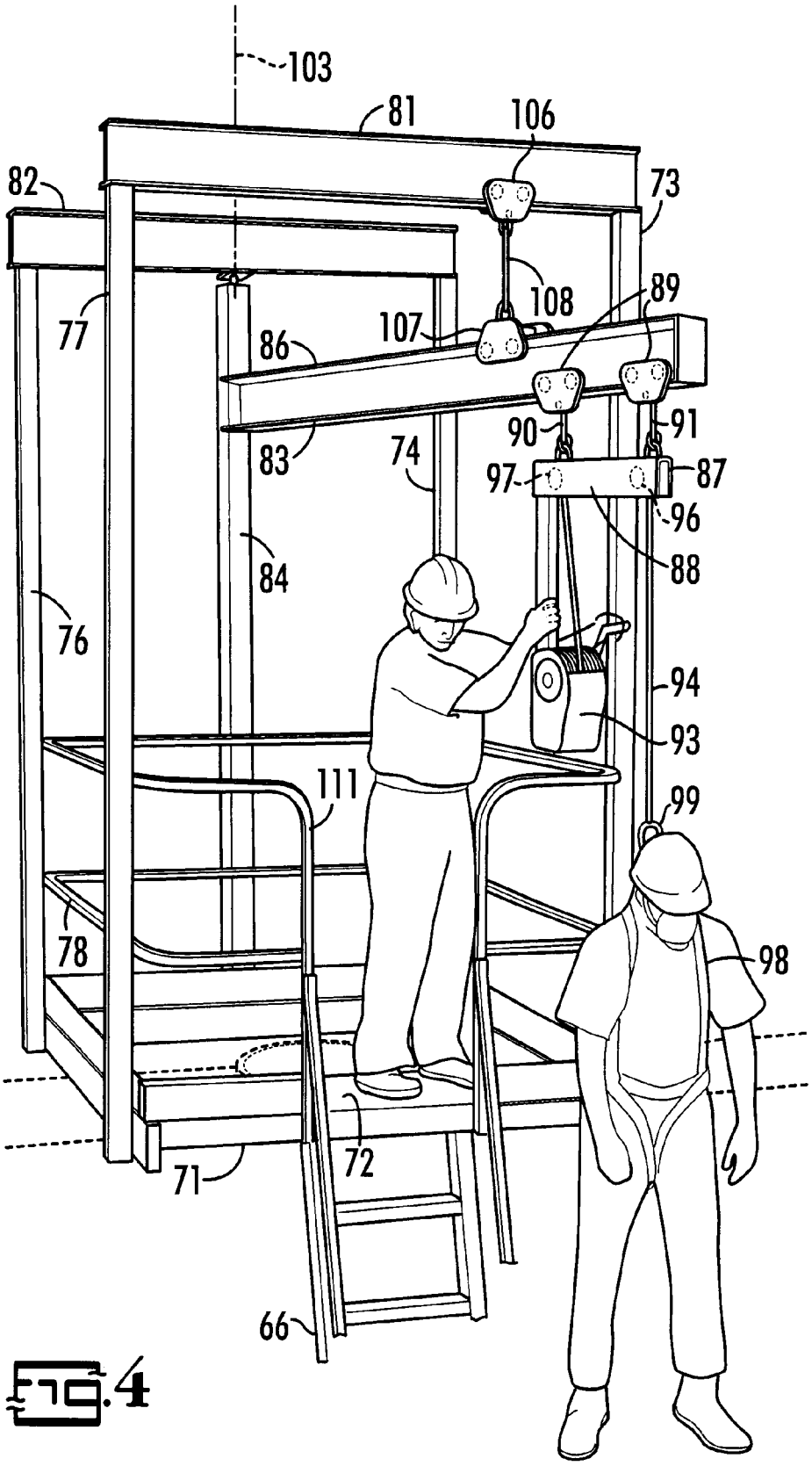
FIG. 4 is a perspective view of the platform of the second embodiment of the invention with the overhead crane lowering a rescued person to the ground.

The mobile human lift unit shown in FIGS. 3 and 4 includes a vehicle 61 with a chassis 62 rigidly supporting the butt section 63 of an extension ladder 64. The extensible section 66 of the ladder 64 supports a work platform 67 having a vertical entryway 68 adapted for placement directly above a top opening of a tank shown by broken lines 69. The vehicle 61 and ladder 64 are of the same general construction as the vehicle 11 and the ladder 27 shown in FIG. 1. The platform 67 includes a floor frame 71 supporting a partial floor 72 and defining the vertical entryway 68. The corners of the four sided floor frame 71 support four corner posts 73, 74, 76, 77 to which a safety railing 78 is secured. A first overhead support beam 81 is secured by welding to the upper ends of the posts 73, 77 and a second overhead support beam 82 is welded to the upper ends of the posts 74, 76. An overhead crane 83 is provided on the platform 67 which includes a pivotable mast 84 pivotally connected at its top to the beam 82 and pivotally connected at its bottom to the floor frame 71. A horizontally extending boom or track 86, which may be a flanged beam such as an I-beam, has one end rigidly secured, as by welding to the mast 84 a free end extending beneath and beyond the beam 81.

The overhead crane 83 includes a trolley 87 having a horizontal leg 88 supported on the track 86 by a pair of dollies 89, connected to the horizontal leg 88 by a pair of tension links 90, 91. The trolley 87 also includes a vertical let 92 to which a hand operated winch 93 is secured. The winch includes a cable 94 reeved on a pair of pulleys 96, 97 rotatably mounted on the horizontal leg 88 of the trolley 87. The free end of the cable 94 includes a releasable connector 99 adapted for connection to a human lift harness 98. The mast 84 of the overhead crane 83 is pivotally connected at its top and bottom to the beam 82 and the floor frame 71, respectively, by pivot pins 101, 102 for swinging movement about a vertical axis 103. In order to provide additional support for the free end of the track 86, a dolly 106 is installed on the beam 81 and a dolly 107 is installed on the track 86. The dollies 106, 107 are interconnected by a tension member in the form of a rod 108. The free end of the track 86 extends horizontally beyond the floor frame 71 to permit a rescued person to be moved through a gate 111 in the safety railing 78.

Practical Application

A workman may accidently be overcome by fumes in a container in which he is working or preforming an inspection. Many containers can be accessed only through a top opening and such containers render rescue operations difficult. In rescuing a person from a container with a top opening, time is almost always a critical consideration; particularly in those instances where the fumes are life threatening. The mobile human lift unit of this invention provides equipment which can quickly be placed in a position for a human rescue operation and includes vertical lift apparatus for removing the rescued person from the container. The lift unit is also useful in lowering a person assisting in the rescue effort into the container. As shown in FIGS. 3 and 4, the lift unit not only lifts a rescued person from the container, but also is operable to move the incapacitated person through the gate 111 in the railing 78, to swing the crane 83 about its vertical axis 103 and to lower the rescued person to the ground at one lateral side of the support vehicle 61. In addition to rescue operations, the lift unit is advantageously used to lower workers into, and remove workers from, an enclosure in which work needs to be performed.

Other aspects, objects and advantages of this invention can be obtained from a study of the drawings, the disclosure and the appended claims.

What is claimed is:

1. A lift unit for removing a human from an enclosure having a top opening, comprising:

a wheeled vehicle having a chassis, a horizontally disposed platform including
a portion having vertically open entryway and
three support members spaced about said entryway, a support structure between said chassis and said platform in the form of an extension ladder having a butt section secured to said chassis and an extensible fly section supporting said platform, an apparatus operable to extend and contract said ladder to raise and lower said platform, said platform being disposed in elevated position above said chassis wherein a portion extends horizontally beyond a perimeter of said wheeled vehicle in one direction to permit said entryway to be positioned above said top opening of said enclosure, a lift tripod having
an apex positioned above said open entryway,
three legs having upper ends connected to said apex and lower ends supported, respectively, by said support members, and
a pulley rotatably supported on said apex, and a winch including a lift cable reeved on said pulley and having a free end adapted for connection to a human lift harness.

2. The lift unit of claim 1 wherein each of said support members are sockets that are shaped to receive the lower end of an associates leg of said tripod.

3. The lift unit of claim 1 wherein said winch is mounted on one of said legs of said tripod.

4. A mobile lift unit for lifting a human through a top opening of an enclosure, comprising:

a wheeled vehicle having a chassis, a platform including a portion extending horizontally beyond a perimeter of said chassis, said portion having a vertical entryway, a support structure on said chassis supporting said platform at one side of said vehicle including an apparatus for raising and lowering said platform, said apparatus being operable to raise said platform to permit said vertical entryway to be placed over said top opening, a guard railing about the outer perimeter of said platform including a gate in said guard railing, steps on said support structure permitting a human to ascend to and descent from said platform via said gate, and an overhead crane pivotally mounted on said platform for swinging movement about a vertical axes and including a winch with a cable having a free end adapted for connection to a human to be moved vertically through said top opening and through said vertical entryway.

5. The lift unit of claim 4 wherein said overhead crane includes a horizontally extending track and a trolley supported on said track, said trolley including at least one pulley on which said cable is reeved.

6. The lift unit of claim 5 wherein said track is swingable about said vertical axis to a position in which objects suspended from said free end of said cable maybe moved through said gate upon movement of said trolley on said track in a direction away from said vertical axis.

7. The lift unit of claim 6 wherein said overhead track is swingable about said vertical axis to a position permitting lowering of a human to the ground at one lateral side of said steps.

8. The left unit of claim 6 wherein said platform includes an overhead beam spaced horizontally from said vertical axis and above said track, and further comprising a dolly on said overhead beam connected in supporting relation to said track.

9. The lift unit of claim 4 wherein said support structure includes an extension ladder having a butt section secured to said chassis and an extensible section supporting said platform, said steps being on said ladder.

* * * * *